US007726849B2

(12) United States Patent
Haddad et al.

(10) Patent No.: US 7,726,849 B2
(45) Date of Patent: Jun. 1, 2010

(54) TRADITIONAL STYLE POST-TOP LUMINAIRE WITH RELAMPING MODULE AND METHOD

(75) Inventors: Eric Haddad, East Berlin, PA (US); Jason Metzler, Dillsburg, PA (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 12/397,020

(22) Filed: Mar. 3, 2009

(65) Prior Publication Data

US 2009/0168438 A1 Jul. 2, 2009

Related U.S. Application Data

(63) Continuation-in-part of application No. 12/020,333, filed on Jan. 25, 2008, now Pat. No. 7,510,307, which is a continuation of application No. 11/424,935, filed on Jun. 19, 2006, now Pat. No. 7,322,720.

(51) Int. Cl.
*F21V 21/00* (2006.01)

(52) U.S. Cl. ..... 362/309; 362/363; 362/334; 362/374; 362/375; 362/362

(58) Field of Classification Search ..... 362/374, 362/375, 362, 363, 35, 37, 39, 40, 58, 523, 362/526, 530, 531, 129, 132, 141, 142, 144, 362/161, 167, 170, 174, 177, 188, 197, 198, 362/199, 213, 217.03, 249.03, 249.1, 277, 362/392, 393, 418, 427, 429, 447, 449
See application file for complete search history.

(56) References Cited

U.S. PATENT DOCUMENTS

| | | | | |
|---|---|---|---|---|
| 3,317,724 | A * | 5/1967 | Kepenach et al. | 362/311.06 |
| 3,321,619 | A * | 5/1967 | Dailey | 362/367 |
| 3,610,942 | A * | 10/1971 | Arens | 250/237 R |
| 4,719,548 | A * | 1/1988 | Orosz | 362/309 |
| 5,243,508 | A * | 9/1993 | Ewing et al. | 362/431 |
| 6,337,792 | B1 * | 1/2002 | George | 361/674 |
| 7,322,720 | B1 * | 1/2008 | Haddad | 362/309 |
| 7,510,307 | B2 * | 3/2009 | Haddad | 362/309 |

* cited by examiner

*Primary Examiner*—Sandra L O'Shea
*Assistant Examiner*—Danielle Allen
(74) *Attorney, Agent, or Firm*—Middleton Reutlinger; John F. Salazar

(57) ABSTRACT

A luminaire adapted to being mounted at the top of a post having a design reducing maintenance costs. The luminaire has a capital with a globe mounted thereon forming an optical chamber, the capital has a front access area with a front access door hingedly attached thereto and optionally has a tool-less latch capable of holding the front access door over the front access area. The capital has an opening in a top portion thereof into the optical chamber, optionally, a relamping module extends from the inside of the capital, through the opening and up into a central portion of the optical chamber and has a lamp socket thereon. The relamping module may be removed without manipulation of the globe or globe roof. The luminaire may also have electrical gear within the capital attached to a tray wherein the tray is removably attached to an internal portion of the capital. The globe and globe roof may remain stationary during typical maintenance processes such as relamping or maintenance of electrical gear.

16 Claims, 14 Drawing Sheets

TRADITIONAL STYLE POST-TOP LUMINAIRE WITH RELAMPING MODULE AND METHOD

CROSS-REFERENCE TO RELATED APPLICATIONS

This continuation-in-part application under 35 USC § 120 claims priority to, and benefit from, U.S. Utility application Ser. No. 12/020,333, filed on Jan. 25, 2008, entitled, "Traditional Style Post-Top Luminaire with Relamping Module and Method," now U.S. Pat. No. 7,510,307, which is a continuation of U.S. Utility application Ser. No. 11/424,935, filed on Jun. 19, 2006, entitled "Traditional Style Post-Top Luminaire with Relamping Module and Method," now U.S. Pat. No. 7,322,720.

STATEMENT REGARDING FEDERALLY SPONSORED RESEARCH OR DEVELOPMENT

Not applicable.

FIELD OF INVENTION

This invention relates to a luminaire adapted to be mounted at the top of a post. More particularly, this invention is directed to a luminaire having a new and improved design reducing maintenance costs.

DETAILED DESCRIPTION OF THE PREFERRED EMBODIMENTS

To present a better understanding of the invention, particular embodiments thereof will now be described and illustrated in the Figures. Reference to the Figures showing embodiments of the presently claimed invention are made simply to describe the presently claimed invention and not to limit the scope of the claims herein.

A traditional style post-top luminaire is provided having a design reducing maintenance costs. Optionally, the luminaire has a substantially isolated water and dust tight optical chamber and may incorporate a unique design of tool-less access to a re-lamping module and/or a removable electrical gear tray. Incorporating each of these options provides access to substantially all internal components through a hinged door on a bottom luminaire capital without the need for tools.

A sealed optical chamber is achieved by gasketing between the roof, globe, and bottom luminaire capital. Preferably, a dual radial sealed removable socket casting allows for tool-less removal of a lamp and relamping via access to a relamping module. The dual radial sealing method for a re-lamping module is preferably a submersible rated gasketing method. The relamping module has a relamping post extending upward from a base cooperating with a central portion of a radial sealed socket casting and has a lamp socket thereon. Electrical gear is preferably attached to a removable tray mounted in the capital which is removable and replaceable in a tool-less manner.

A user has access to the lamp for replacement and servicing of the electrical gear at the same time via an optional tool-less latch through a bottom capital. Thus, a post-top luminaire may have totally tool-less access and the capability to service most all of the components that require typical maintenance in a tool-less manner.

Figure 1:
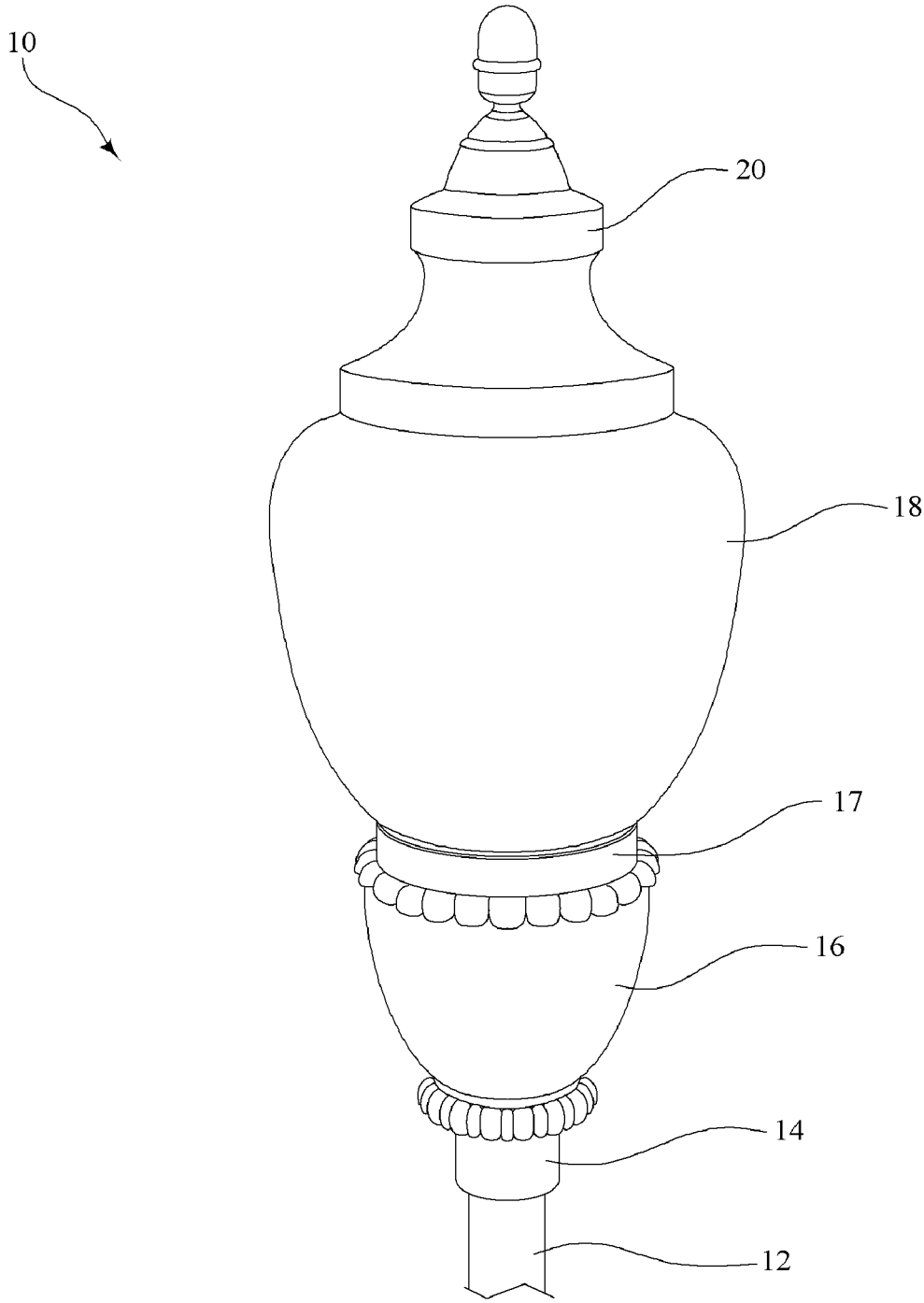
FIG. 1 is a perspective view of an embodiment of the luminaire mounted on the top of a post showing the external components thereof.

With reference to FIG. 1, luminaire 10 is illustrated in one position mounted at the top of a post 12. The external structure of the luminaire 10 is substantially symmetrical about a central vertical axis, and thus FIG. 1 illustrates the exterior of the luminaire 10 as perceptively viewed from substantially any side thereof. From an external perspective, luminaire 10 generally comprises a luminaire base 14 supporting a capital 16. Capital 16 has an opening in the top thereof wherein globe 18 is sealably retained forming an optical chamber within. Atop globe 18 is roof 20 which sealed to globe 18 forming an optical chamber substantially sealed off from the exterior environment. Roof 20 is optional as globe 18 could have a top without an opening therein. Preferably, globe 18 is an acorn globe.

Figure 2:
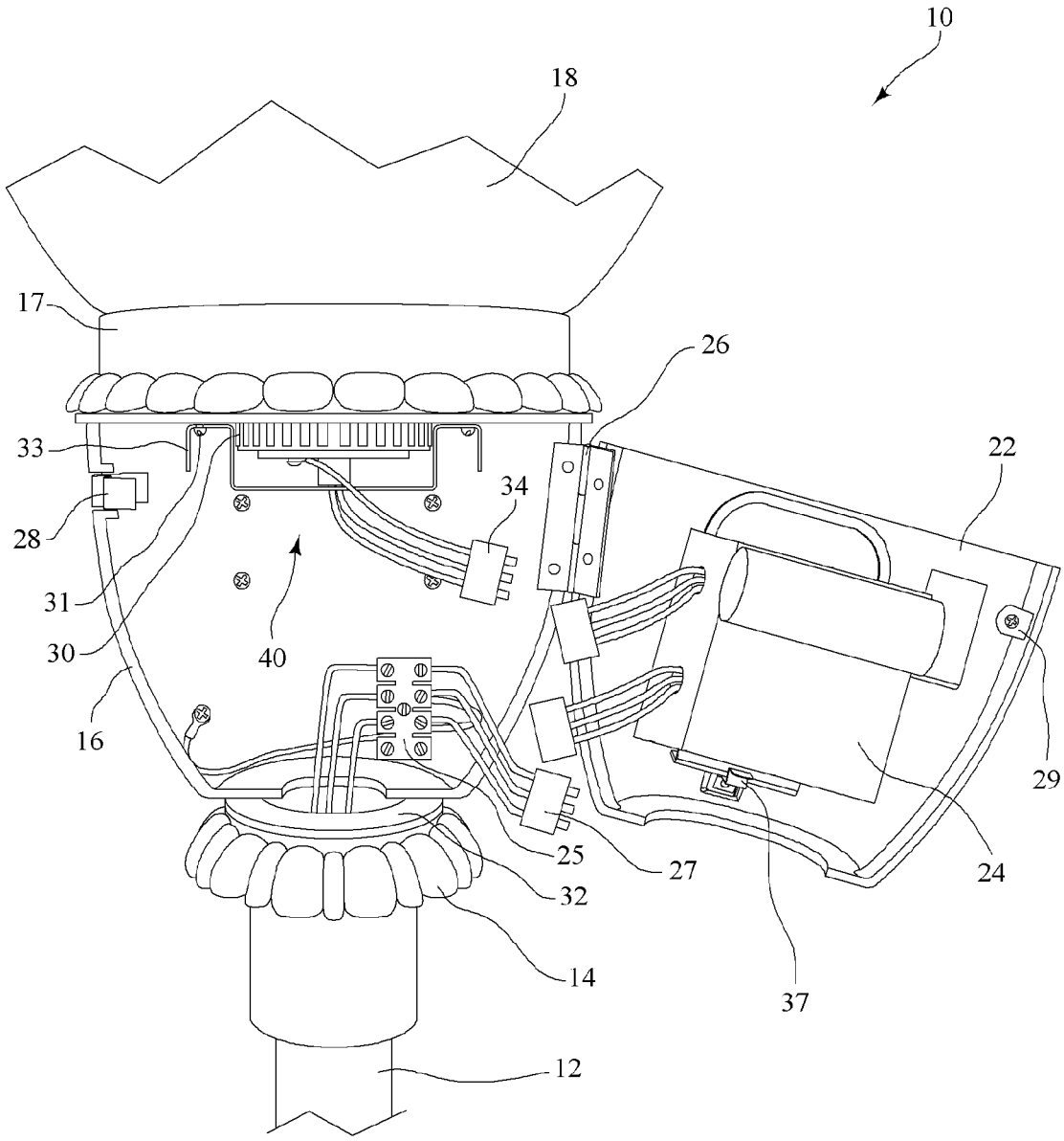
FIG. 2 is a view of the luminaire of FIG. 1 having a door in the capital being open showing the internal components thereof.
Figure 3:
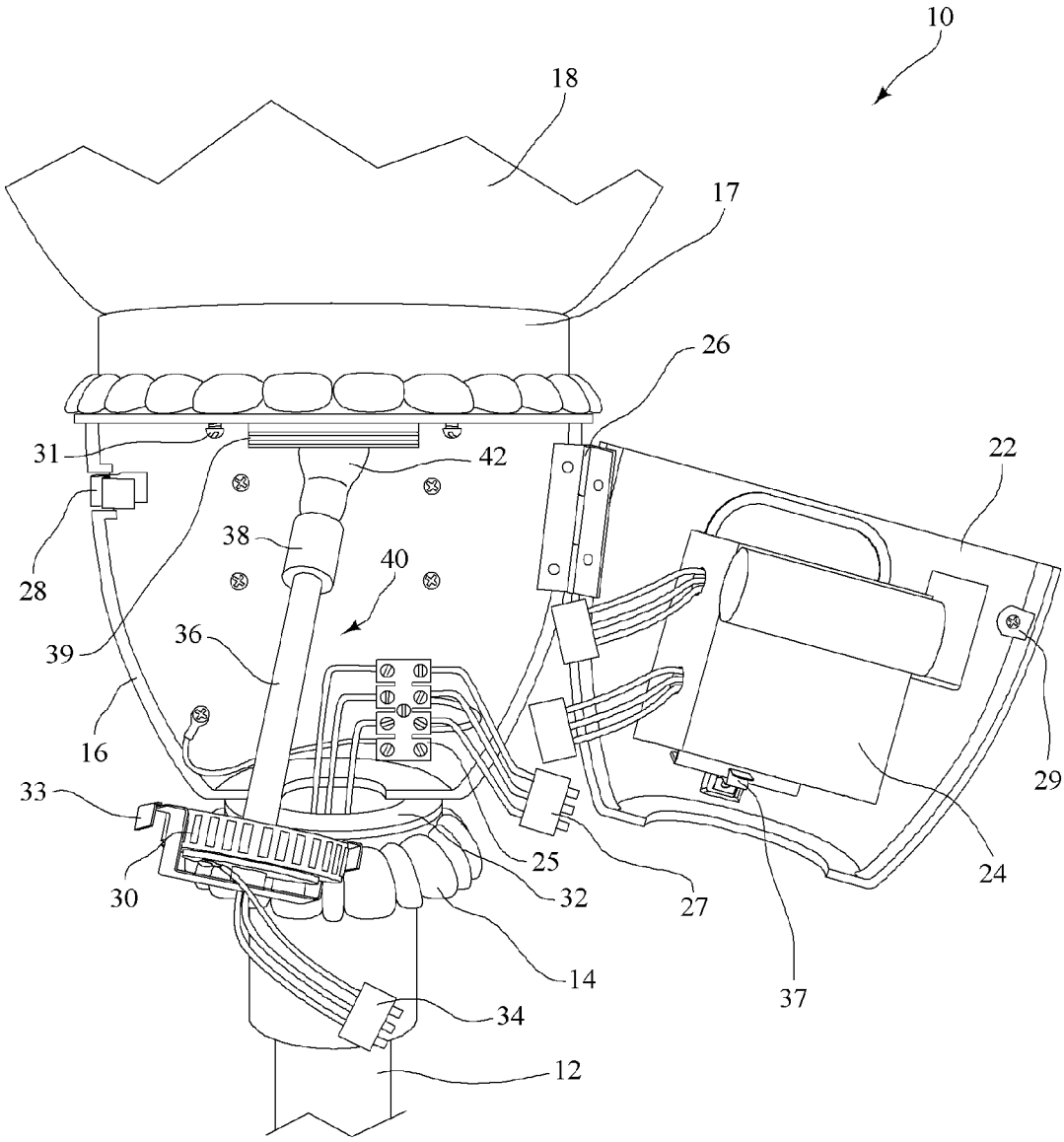
FIG. 3 is a view of the luminaire of FIG. 1 having a partial cutaway of the capital showing a gasket and the partial removal of a relamping module.

With reference to FIGS. 2 and 3, luminaire 10 has capital 16 attached to base 14 with cast top 32 there between. Base 14 resides atop post 12. Capital 16 has door 22 open showing the internal components therein. Electrical assembly 24 is removably retained within capital 16 with retainer 37, being retained on door 22, providing easy access and removability. Door 22 is attached to capital 16 via hinge 26. Tab 29 is attached near an edge of door 22 and is oriented to cooperate with tool-less latch 28 on capital 16 providing tool-less access to electrical gear assembly 24, relamping module 40, and other internal components thereof. FIG. 2 shows relamping module 40 in a sealed position within capital 16 about dual radial sealed socket casting 39 with relamping module sealing base 30. Relamping module sealing base 30 seals about dual radial sealed socket casketing 39 with a twisting action or vertical placement thereon. Optionally, threads are about an outer portion of dual radial sealed socket casting 39 which cooperate with optional threads on an inner surface of relamping module sealing base 30. FIG. 3 shows relamping module sealing base 30 released and removed from dual radial sealed socket casting 39 as is done when relamping. Relamping module 40 is shown partially removed exposing relamping post 36, socket 38, and lamp 42. Lamp electrical connection 34 is removed from electrical assembly 24 and optional retaining bracket 33 is rotatingly removed from retainers 31. Terminal block 25 resides within capital 16 and serves as a connector to an external power supply via wires extending through luminaire base 14 and post 12. Electrical connector 27 is in electrical communication with terminal block 25 and removed from electrical assembly 24. Outer globe ring 17 is shown having a decorative outer surface sealingly holding globe 18 on capital 16.

Figure 4:
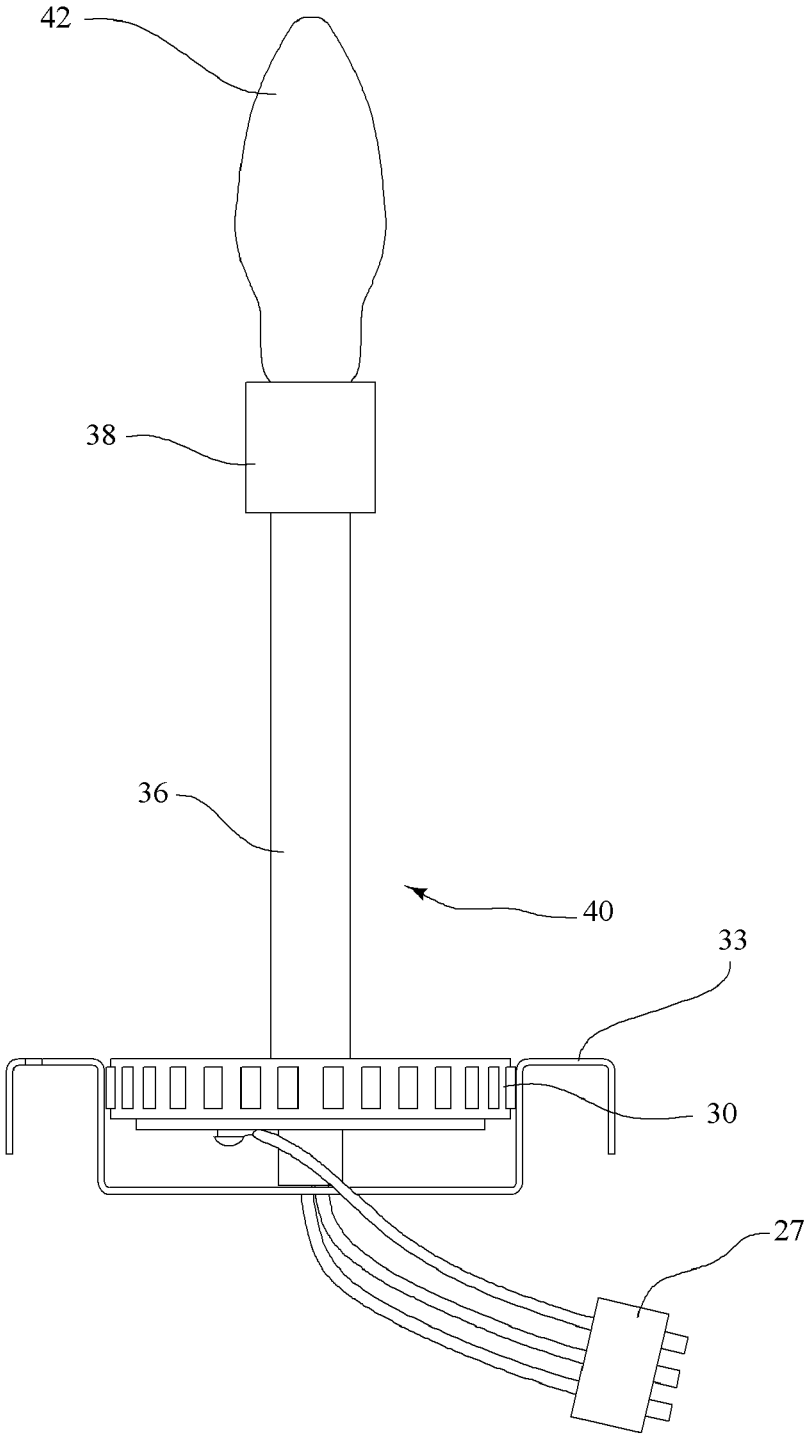
FIG. 4 is a view of the relamping module of the luminaire of FIG. 1.

FIG. 4 shows a relamping module 40. Relamping module 40 has at its base a relamping module sealing base 30 that has an inner circumferential surface which optionally seals to a an optional single or dual radial sealed socket casting. Optionally, relamping module sealing base 30 has an internal thread to cooperate with optional external threads on a dual radial sealed socket casting. Alternatively, relamping module sealing base 30 has a smooth inner surface enabling a vertical placement about a dual radial sealed socket casting. Extending upward from relamping module sealing base 30 is relamping post 36 which contains wiring for lamp 42 terminating at connector 27. Relamping post 38 has a length necessary to position lamp 42 within a central portion of globe 18 when relamping module sealing base 30 is sealed onto a dual radial sealed socket casting. Atop relamping post 36 is lamp socket 38 having lamp 42 installed therein. Depending from relamping module sealing base 30 is optional retaining bracket 33 that has slots in an upper portion for twistingly engaging fasteners downwardly depending from outer globe ring 17, shown in FIGS. 2 and 3.

Figure 5:
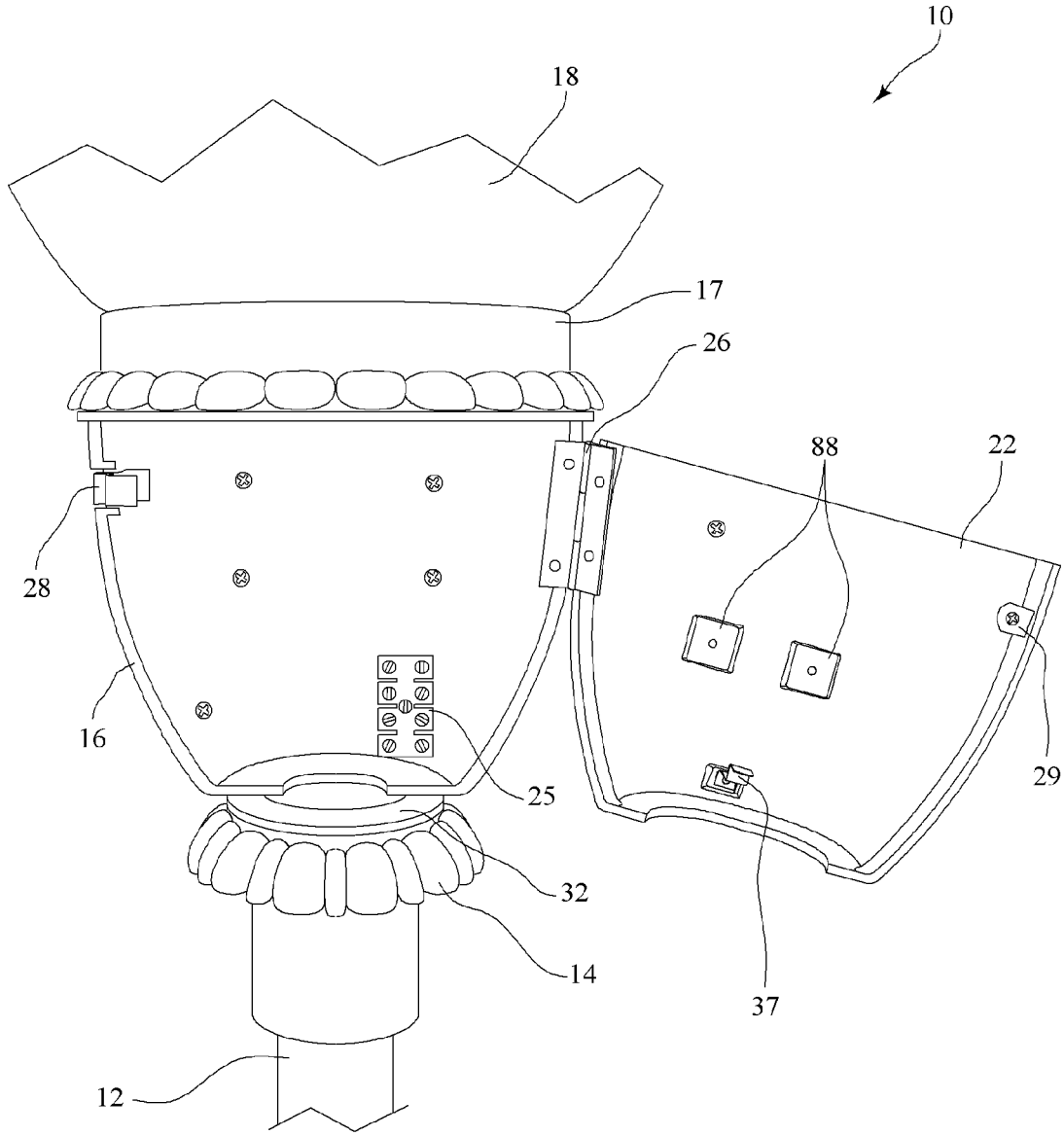
FIG. 5 is a view of the luminaire of FIG. 1 having a door in the capital being open showing the capital with internal components removed therefrom.

FIG. 5 shows a post top luminaire 10 having door 22 in capital 16 being open showing the internal components removed for maintenance. Capital 16 is attached to base 14 having cast top 32 and has globe 18 sealably retained thereon forming an optical chamber within. Base 14 resides atop post 12. Capital 16 has door 22 open showing electrical assembly 24 removed therefrom showing mounts 88. Mounts 88 and retainer 37 enables for a tool-less removal and replacement of electrical assembly 24. Door 22 is attached via hinge 26. Tab 29 is attached near an edge of door 22 and is oriented to cooperate with tool-less latch 28 on capital 16 providing tool-less access to electrical assembly 24 and relamping module 40. Atop capital 16 is outer globe ring 17 holding globe 18 thereon. Terminal block 25 is shown attached an inner wall of capital 16 having all electrical wires removed therefrom.

Figure 6:
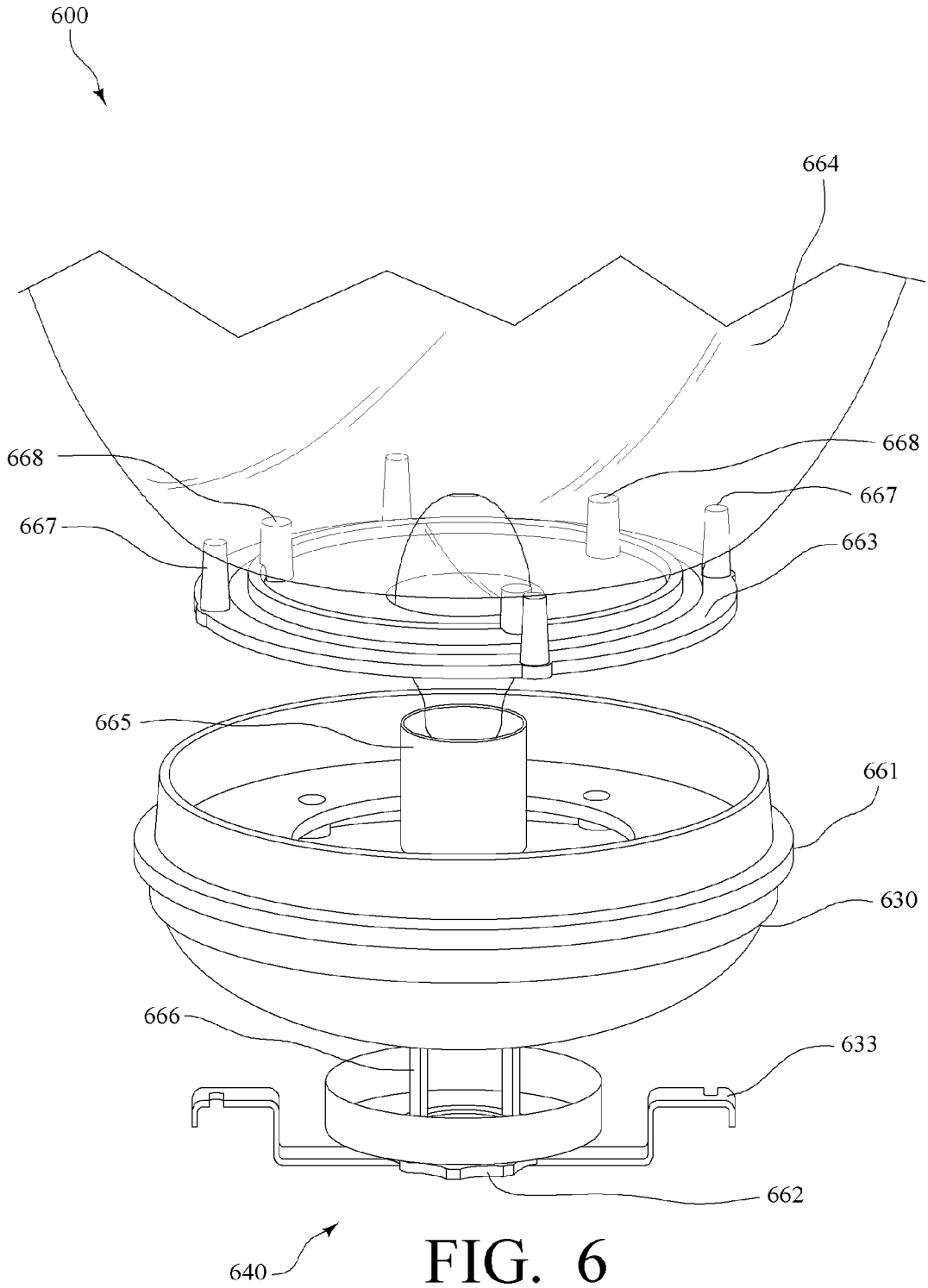
FIG. 6 is a cutaway view of a post-top luminaire showing the interrelationship between the relamping module and upper portion of the luminaire.

FIG. 6 shows post-top luminaire 600 having relamping module 640, outer globe ring 661, and inner globe ring 663 in an exploded view showing the interrelationship between these component parts. Relamping module 640 has retaining bracket 633 extending radially from relamping module sealing base 630. Retaining bracket 633 has notches proximate each end for twistingly engaging fasteners extending downward from outer globe ring 661. Depending upward from relamping module sealing base 630 is relamping post 666 having socket 665 mounted atop. Lamp 662 is threadingly engaged within lamp socket 665. Retainer receivers 668 preferably have an internal thread for receiving a fastener holding inner globe ring 663 to outer globe ring 661. Globe posts 667 extend upward from inner globe ring 663 supporting globe 664 thereon.

Figure 7:
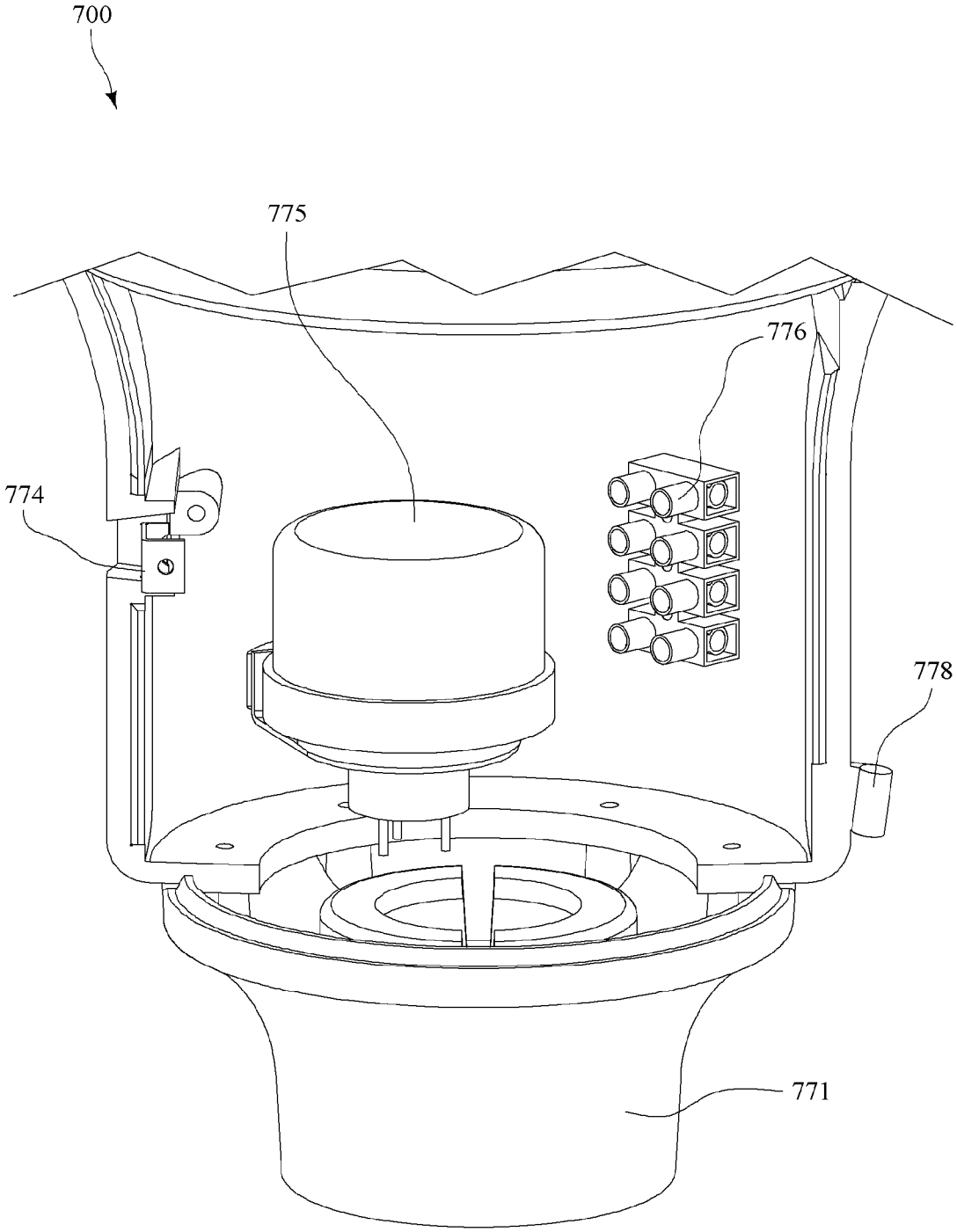
FIG. 7 is a cutaway view of a post-top luminaire showing a capital having a door removed and installed on a base for mounting atop a post.
Figure 8:
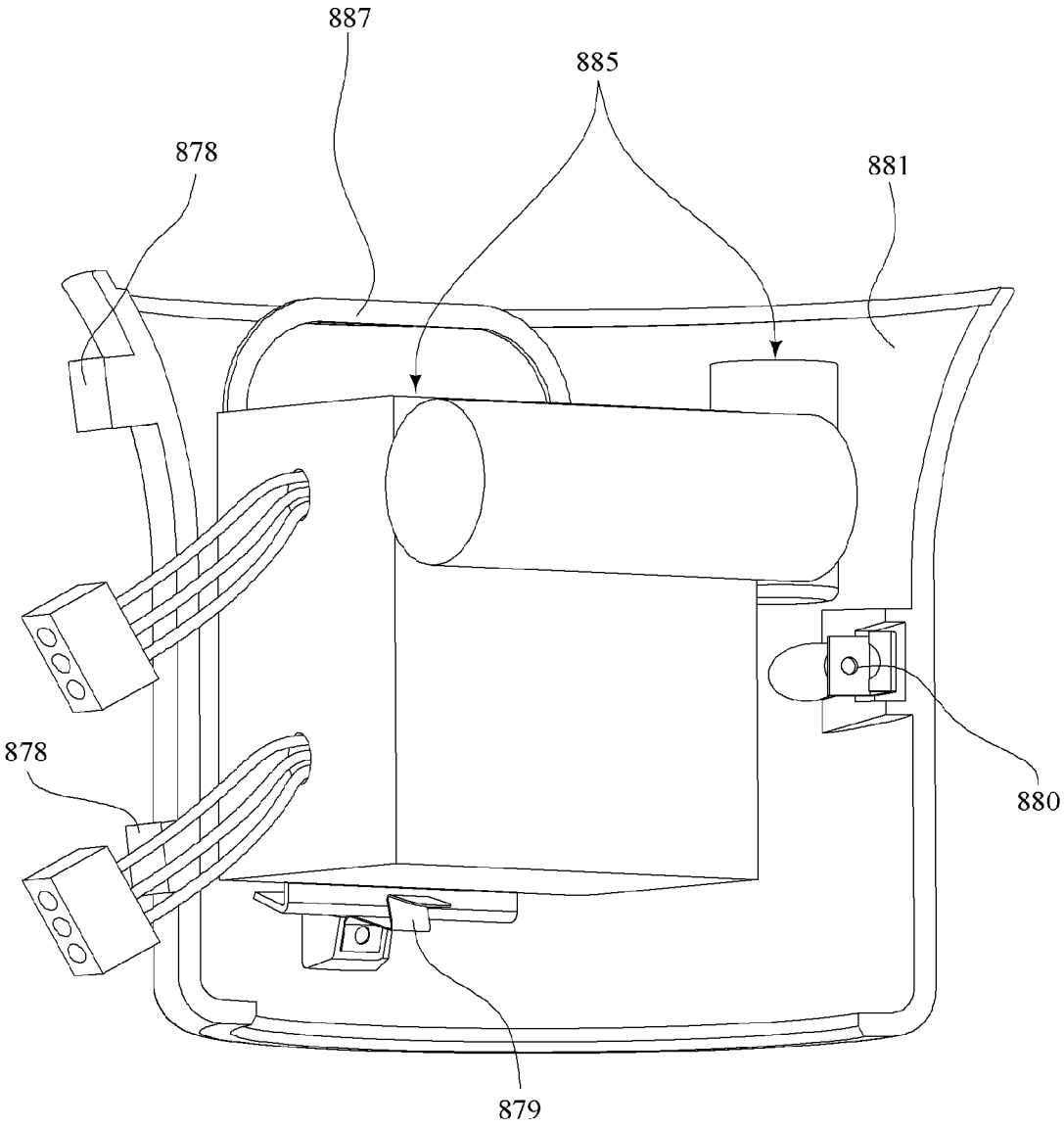
FIG. 8 is a perspective view of a capital door with electrical components mounted therein.

FIG. 7 shows post-top luminaire 700 having capital 770 with a door removed therefrom. Capital 770 is mounted on luminaire base 771 for mounting atop a post. Tool-less latch 774 is near an edge of capital 770 proving tool-less access to the inner portion of capital 770 by holding a door, shown in FIG. 8, in a closed position. On an opposite edge of capital 770 is hinge component 778 for hingedly holding the door. Internal components shown within capital 770 are optional photo control 775 and terminal block 776. FIG. 8 shows capital door 881 with electrical assembly 885 removably mounted therein. Capital door 881 has latch 879 on a lower inner portion thereof cooperating with electrical assembly 885 providing for the tool-less removable of electrical assembly 885. Electrical assembly 885 has handle 887 extending from an upper portion for tool-less removal. Lower and upper hinge components 878 cooperate with hinge components 778 on capital 700, shown in FIG. 7. Tab 880 cooperates with tool-less latch 774 providing tool-less access to the internal components of luminaire 700 having door 881.

Figure 9:
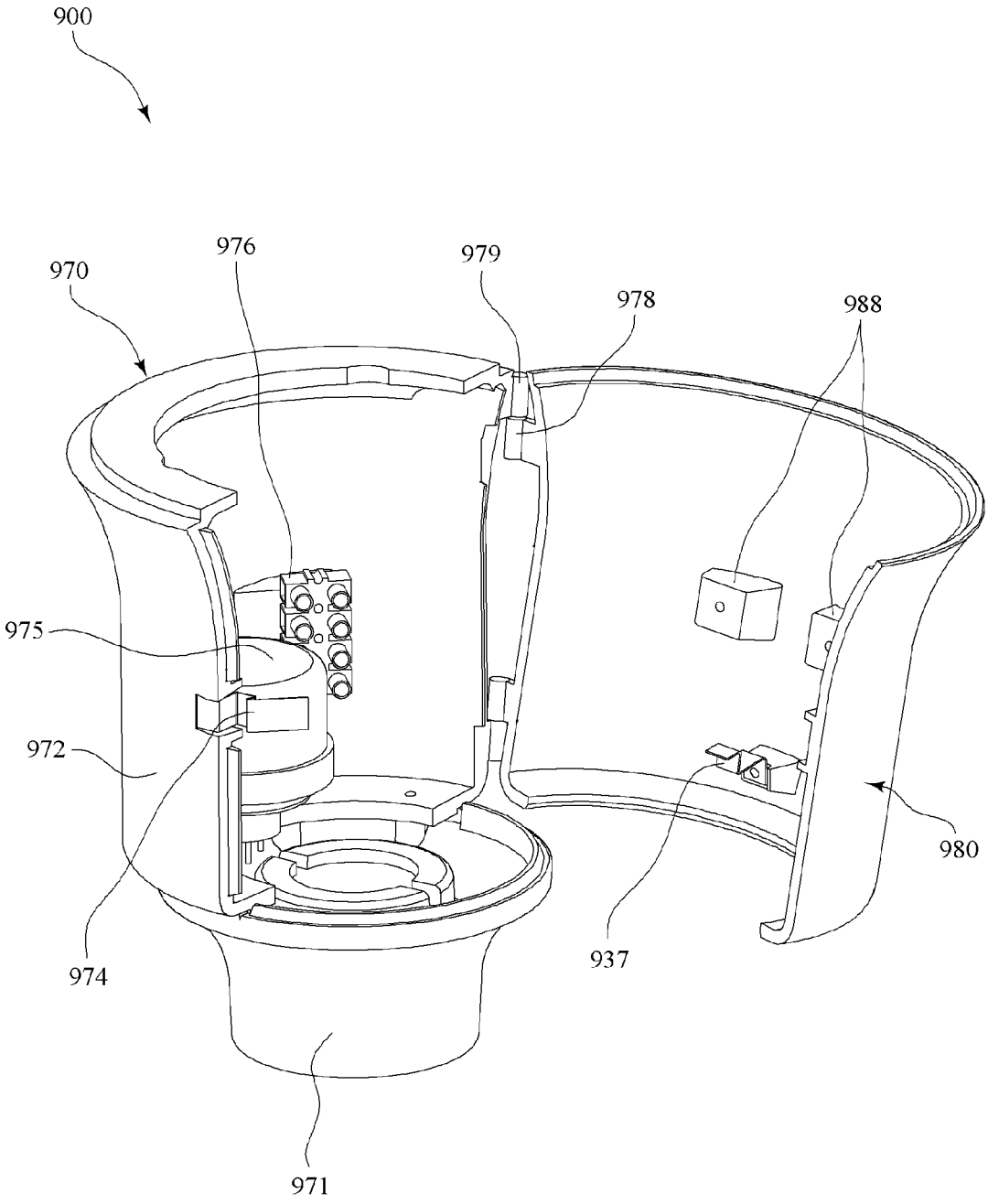
FIG. 9 is a perspective view of the capital of FIG. 7 having the capital door of FIG. 8 mounted thereon.

FIG. 9 shows post-top luminaire 900 having capital 970 with capital door 980 hingedly attached thereto. Capital 970 is mounted on luminaire base 971 for mounting atop a post. Tool-less latch 974 is near an edge of capital 970 proving tool-less access to the inner portion of capital 970 and capital door 980. Hinge components 978 and 979 cooperate to hingedly hold capital door 980 to capital 970. Internal components shown within capital 970 are optional photo control 975 and terminal block 976. Capital door 980 has an electrical assembly removed therefrom exposing mounting blocks 988 and latch 937 which cooperate with the electrical assembly providing tool-less removal.

Figure 10A:
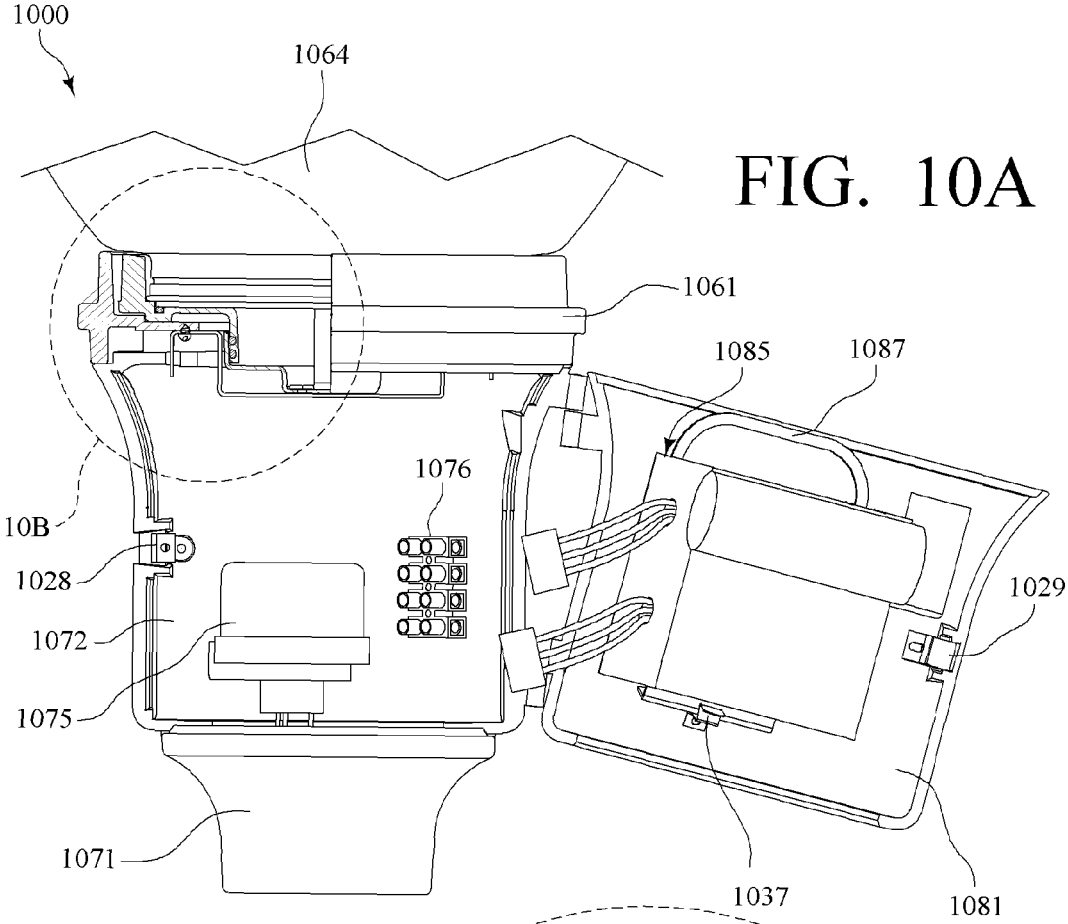
FIGS. 10A and 10B is a partial cut-away view of a post top luminaire showing the dual radial sealing method and cooperation between the upper components of the luminaire.
Figure 10B:
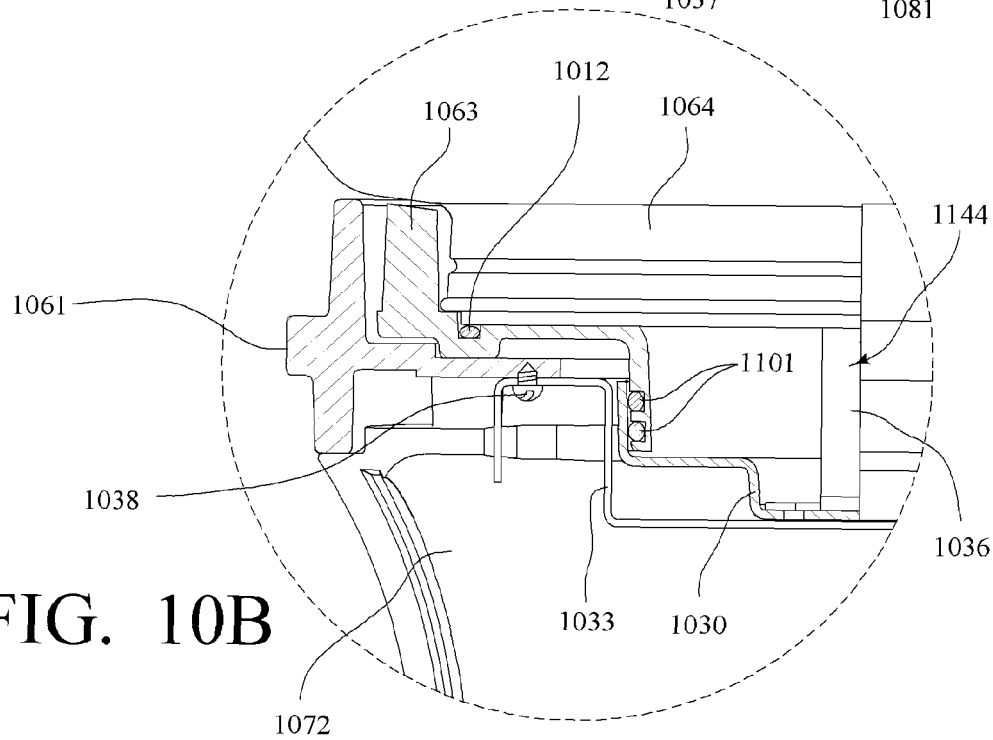

FIGS. 10A and 10B show a partial cut-away view of post top luminaire 1000 detailing the dual radial sealing method and cooperation between the capital 1072, outer globe ring 1061, inner globe ring 1063, relamping module 1144, and globe 1064. FIG. 10A shows luminaire 1000 having an upper sectional cut-away detailed in FIG. 10B. Luminaire 1000 has capital 1072 attached to base 1071 for mounting atop a post. Capital 1072 has hingedly attached door 1081 open showing the internal components therein. Electrical assembly 1085 is removably retained on door 1081 with retainer 1037 providing easy access and removability. Electrical assembly 1085 has handle 1087 extending from an upper portion for tool-less removal. Tab 1029 is attached near an edge of door 1081 and is oriented to cooperate with tool-less latch 1028 on capital 1072 providing tool-less access to electrical gear assembly 1085, relamping module 1044, optional photo control 1075, terminal block 1076, and other components therein. FIG. 10B shows an enlarged view of the cut-away portion shown in FIG. 10A detailing the cooperation between capital 1072, dual radial sealing method having seals 1101, outer globe ring 1061, inner globe ring 1063, relamping module 1144, and globe 1064. Relamping module 1144 is shown in a sealed position within capital 1072 with a dual radial sealed socket casting, having dual radial seals 1101, section of inner globe ring 1063. Radial seals 1101 are optional as it is not required to have an air tight seal about relamping module 1144. Optionally, inner globe ring 1063 may have a single radial seal 1101. Relamping module sealing base 1030 has relamping post 1036 depending upward from a central portion and has an outer cylindrical section sealed about dual radial seals 1101. The sealing of relamping module 1144 within inner globe ring 1063 can be done with a twisting action or vertical placement of sealing relamping module base 1030 about dual radial seals 1101 environmentally sealing a lamp atop relamping post 1036 within a central portion of globe 1064. Optionally, threads are about an outer portion of the dual radial sealed socket casting section of inner globe ring 1063 which cooperate with optional threads on an inner surface of relamping module base 1030. Optional retaining bracket 1033 has a central portion engaged with relamping module base 1030 and slots in outwardly and upwardly depending flanges cooperating with retainers 1038 holding relamping module 1044 in a sealed position about dual radial seals 1101. Retainers 1038 threadingly engage and depend downwardly from outer globe ring 1061 having a head separated from outer globe ring 1061 a distance of at least the thickness of retaining bracket 1033 enabling rotating engagement of 1033 with retainers 1038. Also shown here is gasket 1012 cooperating with a lower edge of globe 1064 and located within a recess in inner globe ring 1063. The seal formed between globe 1064 and inner globe ring 1063 with gasket 1012 and the seal formed between relamping module 1144 and inner globe ring 1063 with radial seals 1101 provides tool-less access to a lamp mounted atop relamping post 1036 while providing an environmentally sealed globe 1064.

Relamping of embodiments of the post-top luminaire can be accomplished in a completely tool-less manner. For example, in this embodiment capital door 1081 is opened by releasing tab 1029 from latch 1028. Relamping module base 1030 is then released from a globe ring 1063 in a tool-less manner. In this embodiment base 1030 is rotated in a counterclockwise direction releasing retaining bracket 1033 from retainers 1038. Relamping module 1144 is then lowered from globe 1064 exposing a lamp mounted atop relamping post 1036 allowing removal and replacement of the lamp. The lamp is then placed within the aperture in globe ring 1063 and relamping module 1144 is raised up into globe 1064 and base 1030 is secured to globe ring 1063 with a clockwise rotation. Capital door 1081 is then closed completing the relamping process.

Figure 11:
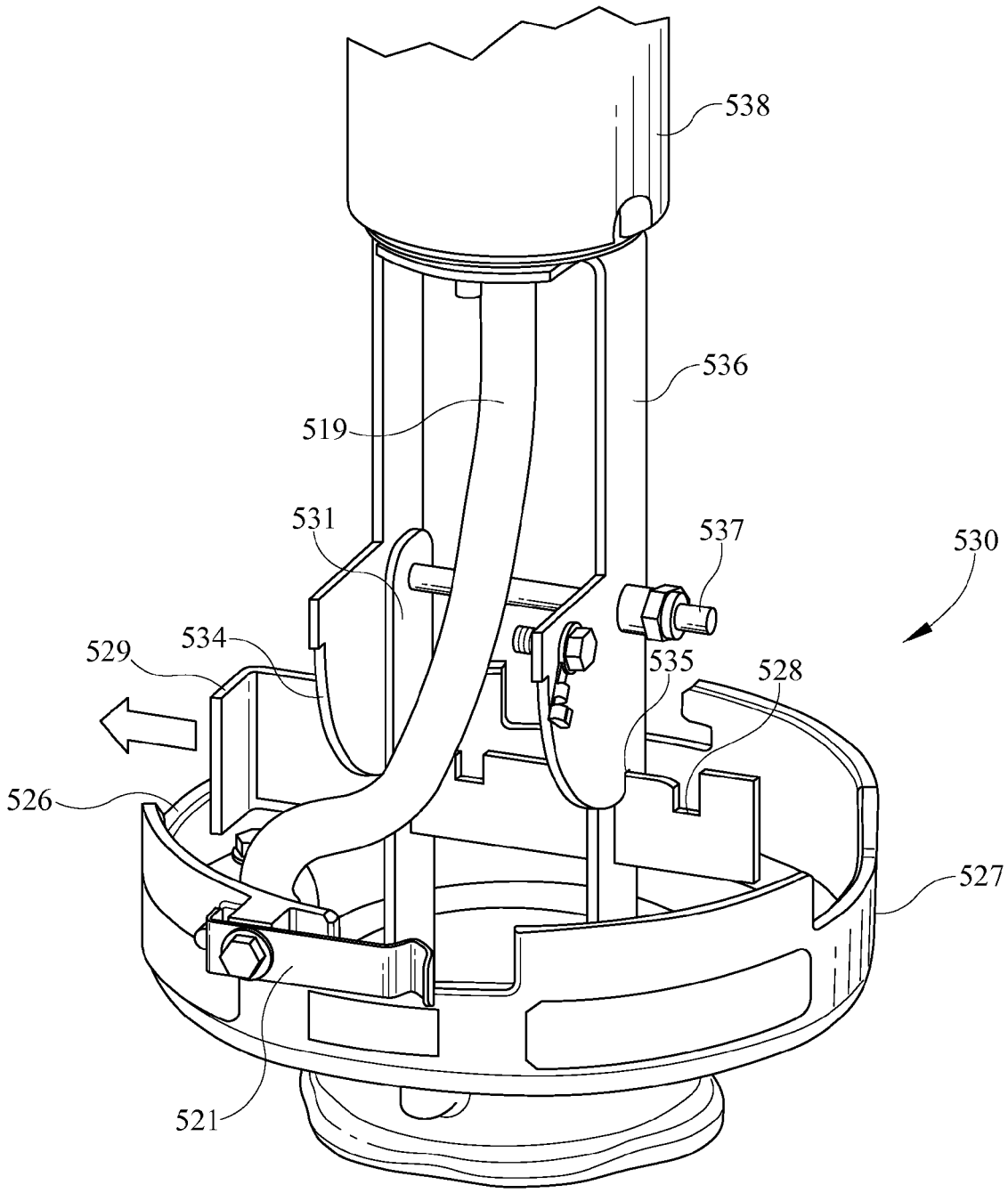
FIGS. 11, 12, 13 and 14 are close-up perspective views of the relamping module cup described herein.
Figure 12:
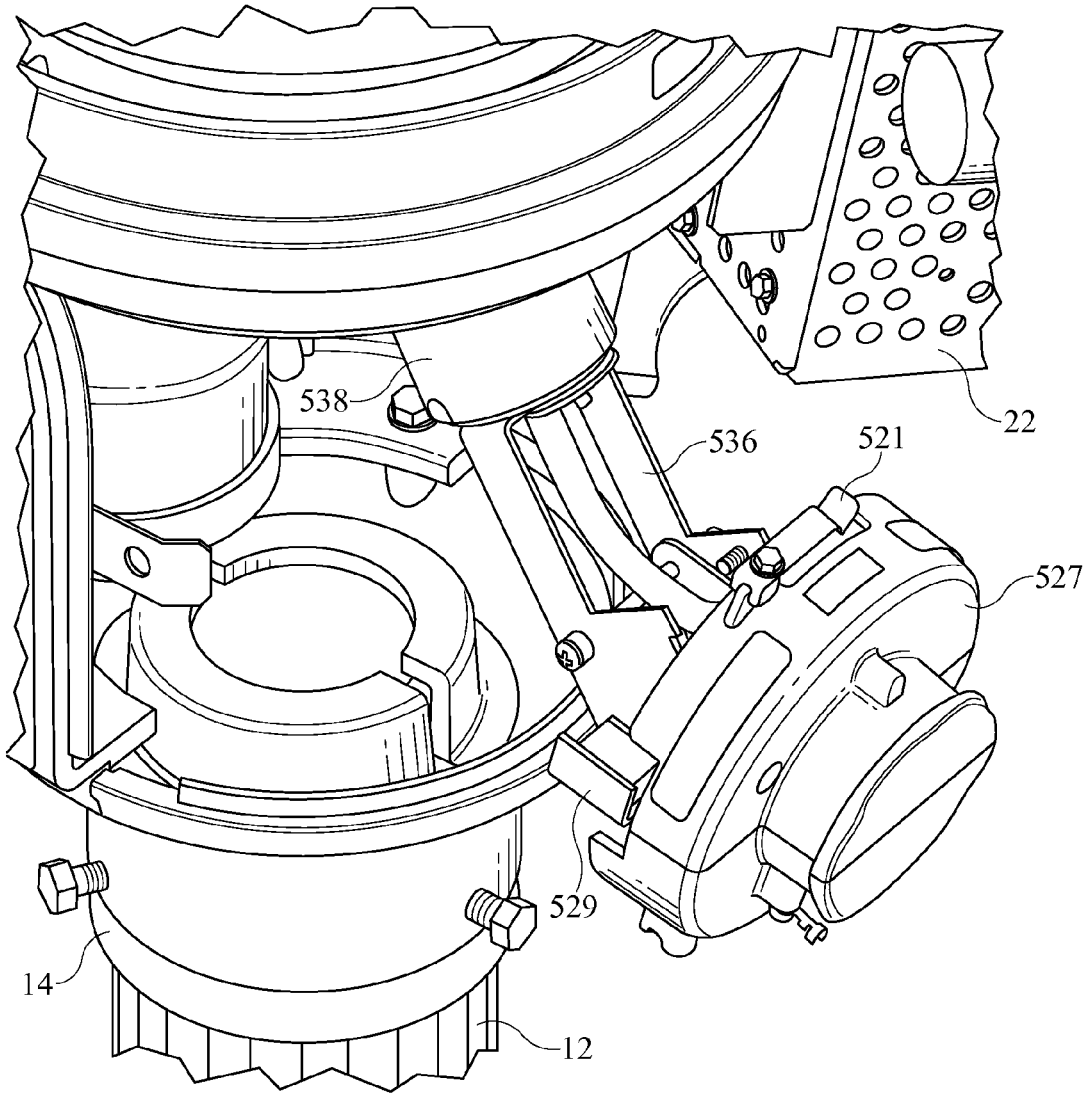
Figure 13:
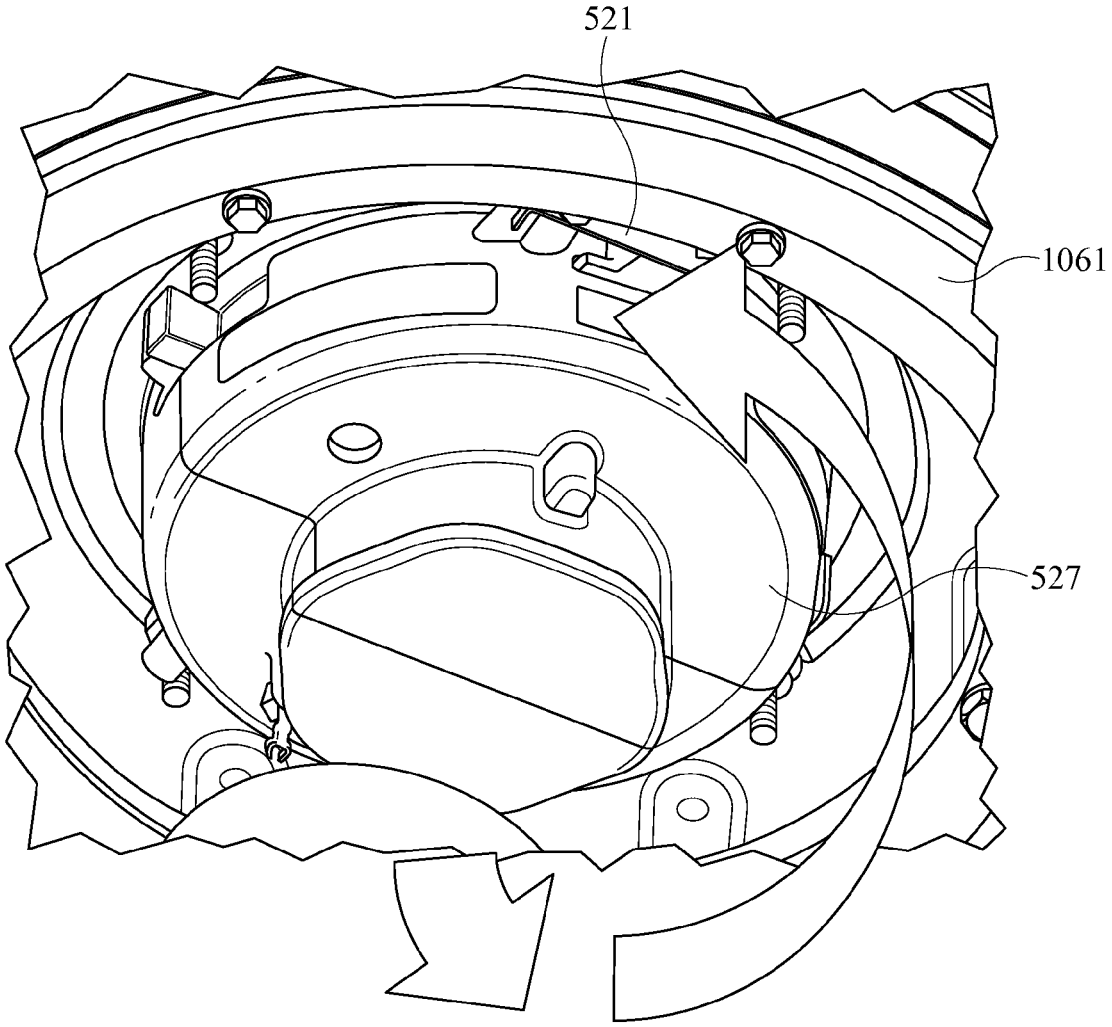
Figure 14:
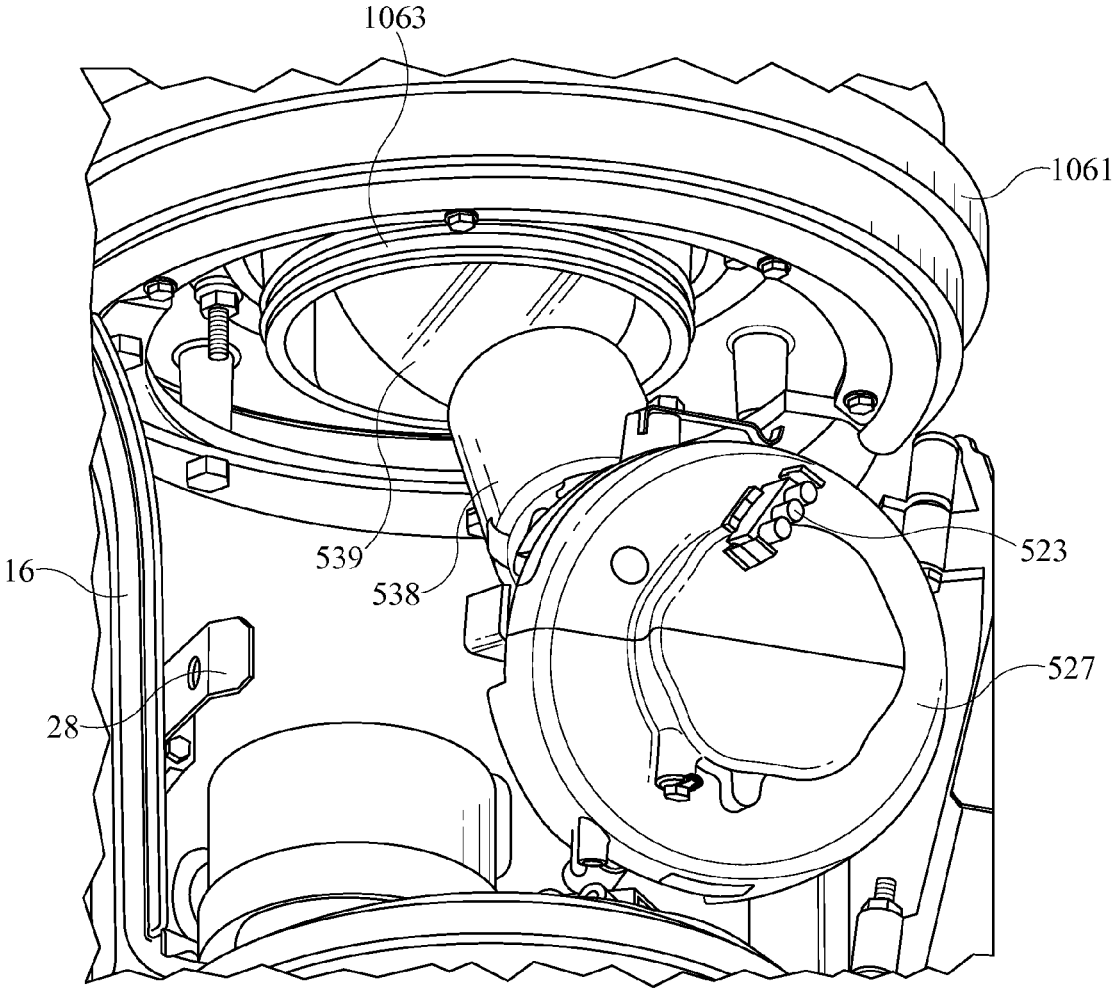

Alternative structure for the relamping module 530 is depicted in FIGS. 11-14. In the variations shown, larger lamp types which are electrically connected to the lamp socket 538 may be accommodated and relamped without removal of the globe 18. As shown in FIG. 11, the lamp socket 538 has an electrical power cord 519 depending through the cup 527 and may be directly affixed to socket connection wiring which extend below the cup 527 and which are directly connectable to the replacement ballast which may be supported on the door 22 of the capital 16. These electrical connections are not shown for ease of simplicity. Lamp socket 538 may retain the larger lamp types which may be removed downward through the capital 16 as shown in FIG. 14 through the use of a hinge or pivot pin 537. Such hinge or pivot pin 537 allows the relamping stem or relamping post to flex relative to the cup 527 so that the relamping module may be removed from the fixture through the opening in the capital 16 covered by the door 22.

Turning to the structure of the pivoting relamping module 530 shown in the figures, in the present embodiment the relamping post or stem may be comprised of an upper relamping post 536 which is hingedly or pivotally connected to a lower relamping post 531 or other structure from cup 527. As depicted, the upper relamping post 536 has a pivot pin 537 extending there through and through the lower relamping post 531. Upper relamping post 536 may also have an arcuate face 534 which has an arcuate face slot 535. Arcuate face slot 535 may receive a slide 529 therein in order to lock the upper relamping post 536 in vertical position relative to the cup 527. Relamping module 530 may have various structures supporting the lamp socket 538 and lamp 539 which may vary from the posts 536 and 531. A single stem may be provided extending directly upwards from the cup or other supporting structure to adequately support and position the lamp 539 in the light chamber and which may be pivotally attached thereto.

A locking mechanism or slide 529 is shown allowing the upper relamping post 536 to be locked in the vertical position. The slide 529 may be a dual position slide, the first position being a locked position wherein the upper relamping post 536 is locked and retained in the vertical position depicted in FIG. 11. The second position may be in the unlocked position wherein the slide 529 is pulled outwardly in the direction of the arrow of FIG. 11 towards the edge of or cup sidewall thereby aligning the slide notches 528 with the arcuate face slot 535 thereby allowing the arcuate face 534 to rotate within the slide notch 528 and allowing the upper relamping post to hinge or flex relative to the cup 527. Cup sidewall 526 will allow the slide 529 to extend shown in FIG. 11 to be placed in a second position to allow pivoting of the upper relamping post 536 relative to the cup 527. Many different structures or embodiments for a locking mechanism may be utilized and implemented in the use of the cup 527 and the relamping stem or relamping post 536. In the various embodiments depicted, a lower relamping post 531 is utilized in combination with the slide 529. However, various structures may be implemented to lock the upper relamping post in vertical position as disclosed.

As a benefit to the design depicted in the figures, slide 529 must be in the locked first position depicted in FIG. 11 in order for the cup 527 to be properly installed on the globe ring 1063 since when in the second position, slide 529 has a handle portion which extends outside the periphery of the cup side wall notch 526 thereby preventing the cup 527 from being affixed to the globe ring 1063. The second position of the slide 529 therefore allows the lamp to be pivoted relative to the cup but also prevents the cup from being installed unless it is adequately locked in such vertical position.

As shown in FIG. 12, the slide 529 is placed in the second unlocked position allowing the upper relamping post 536 to be pivoted relative to the cup 527, thereby causing the slide 529 to extend outward beyond the cup sidewall but allowing the upper relamping post 536 to flex and tilting the socket cup 538 such that the entire relamping module may be pulled out of the fixture and through the aperture in the capital covered by the door 22. Thus, even large lamp types may be removed from the fixture without removal of the globe.

As shown in FIG. 13, the socket cup 527 may be removed from the globe ring through a counterclockwise rotation allowing the spring clips 521 to become disengaged from formed bosses on the globe ring thereby allowing the cup 527 to be removed therefrom. Various wiring connections, which are not shown in the figures for simplicity, may be disengaged between the lamp and lamp socket 538 and the ballast electronics which may be hung on the door 22 and easily connectable to the lamp. Plug 523, shown in FIG. 14 may be implemented on a lower side of the cup 527 in order to allow wiring between the socket, lamp, plug 523, control electronics and ballast components positioned in the capital interior or hung on the door 22. Inner globe ring 1063 shown in FIG. 14, works in conjunction with the globe ring 1061 in order to receive the cup 527 and the bosses formed thereof for engagement with spring clips 521. As can be readily understood, removal of the cup 527 from the inner globe ring 1063 may be accomplished through the disconnection of the cup 527 through rotation relative to the globe ring, downward removal of the cup 527 from the globe ring and positioning of the slide 529 into the secondary unlocked position thereby allowing rotation of the upper relamping post 536 relative to the cup 527 as shown in FIG. 14. Once in such flexed position, the lamp 539 and relamping module 530 may be fully removed through the opening in the capital even when larger lamps are implemented. Also as indicated, when reinstalling the relamping module 530 relative to the globe ring, positioning of the slide 529 in order to lock the upper relamping post 536 in vertical position relative to the cup 527 may be accomplished. Such locking of the slide 529 into the first position and preventing pivoting or rotation of the relamping module prior to installation is desirable such that the lamp 539 is properly positioned within the globe upon installation of the cup 527 to the globe ring. This may be accomplished after insertion of the lamp into the aperture of the globe ring, as shown in FIG. 14, and prior to locking of the cup on the globe ring boss.

Various installation structure may be utilized for combinations with globe ring 1061 and inner globe ring 1063. Such combinations include composite globe rings, inner globe rings, capital and globe ring interface structure all integrated into single unitary units and other known structures which make ease of installation and manufacturing accomplishable. The various structures depicted interfacing both the inner globe ring 1063 and globe ring 1061 are exemplary only as various globe ring structures may be used which allow for an aperture to be formed entering between the capital 16 and the globe 18 while allowing the removal of cup 527 and installation of the cup 527 to an interior portion of the capital thereby properly positioning the lamp 539 within the globe. In the present embodiment, the cup 527 is positioned below the inner globe ring 1063 and substantially covering the aperture formed in the globe ring combination. As mentioned however, various structures may be utilized to implement globe ring and globe structure inter-face in combination with the capital 16.

Capital 16, as previously described, will also have the capital access aperture covered by the capital door 22 which may be hinged directly to the capital for removal. Capital door 22 may be removably placed over the opening within the capital by virtue of door latch 28 thereby allowing access to the interior of the capital and the various electronic components therein which may include the ballast, electronic cabling, optical sensors, plugs and other wiring necessary to maintain the fixture in proper operating form. In the present embodiment, collar 14 may be implemented to integrate both the capital 16 with the support post 12 such that the fixture may be properly positioned atop the post 12.

While embodiments have been set forth for purposes of disclosure, modifications of the disclosed embodiments as well as other embodiments thereof may occur to those skilled in the art. Accordingly, the appended claims are intended to cover all embodiments which do not depart from the spirit of the disclosure.

What is claimed is:

1. A relamping module for a luminaire removable through an opening in a capital, comprising:

a capital with a globe mounted thereon forming an optical chamber within said globe, said capital having an access door hingedly attached to said capital covering an access opening;

a relamping module having a stem supporting a lamp socket and a cup affixed to said stem, wherein said relamping module is mountable within said capital to insert said stem and lamp into said optical chamber;

wherein said stem is pivotable relative to said cup, said relamping module removable downward and through said access opening of said capital.

2. The relamping module of claim 1 wherein said relamping module has a slide to lock said stem in a vertical position.

3. The relamping module of claim 2 wherein said slide extends through at least one slot in said stem.

4. The relamping module of claim 3 wherein said module includes:

an upper relamping post pivotable relative to a lower relamping post, said upper relamping post having an arcuate face, said arcuate face having a slot, said slot of said arcuate face of said upper relamping post receiving said slide;

said slide having at least one slide notch allowing said arcuate face to rotate therethrough when said slide is positioned in an unlocked position.

5. The relamping module of claim 1 further comprising:

said relamping module stem having an upper relamping post pivotable relative to a lower relamping post, said lower relamping post affixed to said cup of said relamping module;

a slide extending through said lower relamping post and positionable in a locked position and unlocked position;

wherein said slide unlocked position prevents said cup from being mountable in said capital.

6. The relamping module of claim 5 wherein said upper relamping post has an arcuate face, said arcuate face having a face slot through which extends said slide, said arcuate face rotatable through a slide notch in said slide when said slide is in said unlocked position allowing said upper relamping post to pivot relative to said cup.

7. The relamping module of claim 5 wherein said slide unlocked position extends an end of said slide past an outer periphery of said cup.

8. The relamping module of claim 1 wherein:

said stem has an upper relamping post and lower relamping post;

said upper relamping post has a first and a second leg pivotably affixed to a first and second leg of said lower relamping post;

a slide extending through said first and second leg of said lower relamping post and having a first and second slide notch;

wherein each of said first and second leg of said upper relamping post have an arcuate face with a slot;

wherein said slide extends through said slot in said arcuate face to lock said upper relamping post in a vertical position;

said slide positionable in an unlocked position placing said slots of said arcuate face in alignment with said slide notches of said slide.

9. A luminaire adapted to being mounted at the top of a post comprising:

a capital having a globe mounted thereon forming an optical chamber, said capital having a front access area with a front access door hingedly attached thereto, said capital having a latch capable of holding said front access door over said front access area substantially enclosing said front access area;

wherein said capital has an opening in a top portion leading into said optical chamber of said globe, a relamping module extending upwards from said interior of said capital, through said opening and into said optical chamber and having a lamp socket;

said relamping module removable downward through said capital opening and said front access area for relamping of said globe luminaire without removal of said globe from said capital; and wherein said relamping module has a lamp socket affixed to a post, said post pivotably affixed to a cup, said cup removably retained in said capital.

10. The luminaire of claim 9 wherein said relamping module post has an upper relamping post pivotably affixed to a lower relamping post extending upwards from said cup.

11. The luminaire of claim 9 wherein said cup further has a lock structure preventing pivotable rotation of said post with said cup in a first position and allowing pivotable rotation of said post with said cup in a second position.

12. The luminaire of claim 11 wherein said lock structure is a slide.

13. The luminaire of claim 9 wherein said post has an upper relamping post pivotably affixed to a lower relamping post, said lower relamping post having a locking structure positionable in a first position and a second position, said first position preventing pivoting of said upper relamping post, said second position allowing pivoting of said upper relamping post.

14. The luminaire of claim 9 wherein said post has an upper relamping post having at least one arcuate face, a pivot pin extending through said upper relamping post and a lower relamping post, said upper relamping post rotational about said pivot pin; a locking slide extending through said lower relamping post; said arcuate face having at least one face slot; said slide further having at least one slide notch; wherein said slide is positionable in a first position causing said slide to abut said face slot and preventing rotation of said upper relamping post, said slide positionable in a second position aligning said slide notch with said arcuate face and allowing rotation of said upper relamping post.

15. A relamping module for a luminaire, comprising:

a globe mountable to a glove ring, said globe ring affixed to a capital and having an aperture, said capital having an access door hingedly affixed to said capital and covering an access opening;

a relamping module having a cup and a stem extending upwards from said cup, said cup mountable within said capital to position said stem within said globe;

said stem pivotable relative to said cup;

wherein said relamping module is removable from said capital downward through said access opening.

16. The relamping module for a luminaire of claim 15 wherein said stem has an upper relamping post and a lower relamping post, said upper post pivotable relative to said lower relamping post, said relamping module having a locking structure positionable in a first and a second position, said first position allowing rotational movement of said upper relamping post relative to said lower relamping post, said second position preventing rotational movement of said upper relamping post relative to said lower relamping post.

* * * * *